US009090269B2

(12) United States Patent
Vogt et al.

(10) Patent No.: US 9,090,269 B2
(45) Date of Patent: Jul. 28, 2015

(54) KEY LOCK AND ARRANGEMENT HAVING A KEY LOCK

(75) Inventors: Olaf Vogt, Berlin (DE); Wolfgang Windolf, Schwülper (DE); Peter Ziegler, Braunschweig (DE)

(73) Assignee: Siemens Aktiengesellschaft, Munich (DE)

( * ) Notice: Subject to any disclaimer, the term of this patent is extended or adjusted under 35 U.S.C. 154(b) by 218 days.

(21) Appl. No.: 13/817,576

(22) PCT Filed: Aug. 2, 2011

(86) PCT No.: PCT/EP2011/063299

§ 371 (c)(1),
(2), (4) Date: Mar. 25, 2013

(87) PCT Pub. No.: WO2012/022613

PCT Pub. Date: Feb. 23, 2012

(65) Prior Publication Data

US 2013/0206924 A1 Aug. 15, 2013

(30) Foreign Application Priority Data

Aug. 18, 2010 (DE) ..... 10 2010 034 903

(51) Int. Cl.
*B61L 5/10* (2006.01)
*B61L 19/06* (2006.01)

(52) U.S. Cl.
CPC . *B61L 5/102* (2013.01); *B61L 5/10* (2013.01); *B61L 19/06* (2013.01)

(58) Field of Classification Search
CPC .... B61L 5/10; B61L 5/02; B61L 19/06;B61L 19/10; B61L 19/12; B61L 19/14; B61L 19/16; B61L 2019/065; B61L 5/107; B61L 5/102; B61L 7/06; B61L 7/065; E05B 2047/0007; E05B 11/00; E05B 47/00; E05B 47/0002
USPC ..... 246/414, 219, 400, 1 C, 411, 393
See application file for complete search history.

(56) References Cited

U.S. PATENT DOCUMENTS

| | | | | |
|---|---|---|---|---|
| 7,140,577 | B2 | 11/2006 | Mollet et al. | |
| 7,416,159 | B2 * | 8/2008 | Beaman et al. | 246/219 |
| 2010/0072326 | A1 * | 3/2010 | Click et al. | 246/393 |

FOREIGN PATENT DOCUMENTS

| | | | |
|---|---|---|---|
| CN | 212744 | A | 11/1992 |
| CN | 2741843 | Y | 11/2005 |
| CN | 201236548 | Y | 5/2009 |
| CN | 201369258 | Y | 12/2009 |
| DE | 726 009 | C | 10/1941 |
| DE | 198 47 292 | A1 | 4/2000 |
| DE | 102007003630 | A1 | 7/2008 |
| DE | 102007003637 | A1 | 7/2008 |
| EP | 0 957 020 | A1 | 11/1999 |
| EP | 1 946 989 | A2 | 7/2008 |
| EP | 1 946 990 | A2 | 7/2008 |

* cited by examiner

*Primary Examiner* — Mark Le
(74) *Attorney, Agent, or Firm* — Laurence A. Greenberg; Werner H. Stemer; Ralph E. Locher

(57) ABSTRACT

A key lock which can be used particularly flexibly and cost-effectively has a communication device for wire-free linking of the key lock to an actuating mechanism. The key lock further has a cable-independent power supply device for autonomously providing the electrical power required for extended operation of the key lock.

5 Claims, 1 Drawing Sheet

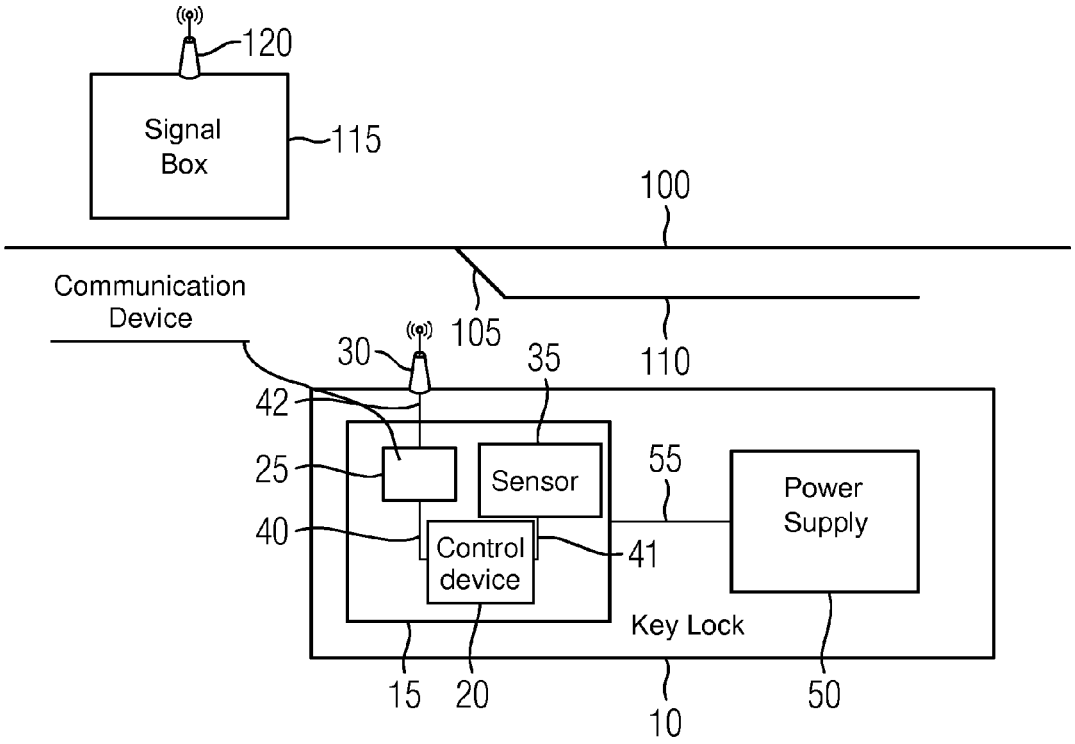
120
Signal Box
115
100
Communication Device
105
110
30
35
42
25
Sensor
55
Power Supply
40
Control device
41
Key Lock
15
20
10
50

KEY LOCK AND ARRANGEMENT HAVING A KEY LOCK

BACKGROUND OF THE INVENTION

Field of the Invention

Key locks are used in rail safety technology for securing manually operated switching elements such as, for example, manual switches. In this context, a key lock usually operates in such a manner that a key required for setting the switching element can be taken from the key lock only when it has previously been released from a signal box. By means of the key, the switching element can thereupon be unlocked and reset and the key can be removed again from the switching element only when the latter is located in its original position again. This ensures that the position or the status of the switching element is known at any time to the signal box. If the key is removed from the key lock, the signal box will prevent that the switching element is used by the signal box or another vehicle. The key thus becomes functionally a token which decides on whether the switching element can be used for the signal box or the signal box hands over control in order to, for example, enable a switch to be reset manually, for example for moving to a side track.

BRIEF SUMMARY OF THE INVENTION

The present invention is based on the object of specifying a key lock which can be used particularly flexibly and cost-effectively.

According to the invention, this object is achieved by a key lock having a communication device for wirelessly linking the key lock to a signal box and a line-independent power supply device for autonomously providing the electrical power needed for operating the key lock.

The key lock according to the invention is advantageous since, due to the omission of external cabling, corresponding expenditures and costs are avoided. This relates, on the one hand, to the communicative linking of the key lock to the signal box. According to the invention, this is carried out wirelessly by means of the communication device, that is to say, in particular, radio-based. On the other hand, the key lock according to the invention does not need any external lines or cables for providing the electrical power needed for operating it, either, since the key lock according to the invention has a line-independent power supply device for autonomously providing the power required for operating it.

Apart from the advantage that a cable- or wire-connected linkage of external components to the key lock is omitted due to its design, the key lock according to the invention also has the advantage that, due to the wireless communicative linking of the key lock to the signal box, restrictions are omitted which usually exist with regard to the distance between a key lock and a signal box in the case of a wire-connected linkage. With regard to the wireless linkage of the key lock to the signal box, it should be noted that this is to be understood in such a manner that no cables or lines are to be connected on the part of the key lock for the purpose of communication with the signal box. In this context, it is possible, nevertheless, depending on the respective implementation, that a part of the path between the key lock and the signal box is bridged in a wire-connected manner, for instance in the case of using a mobile radio network, that is to say, for instance, by means of a core network of a mobile radio network.

In a particularly preferred development, the key lock according to the invention has an electronic control device.

Such an electronic control device, which can be implemented, for example, as controller or microcontroller, offers the advantage that digital control of the key lock and of the communication device is made possible. The electronic control device and the communication device can preferably also be implemented as a common component in this context.

According to a further particularly preferred embodiment, the key lock according to the invention is designed in such a manner that the communication device and the electronic control device are connected to one another via at least one communication link. This is advantageous since, as a result, a transmission of control commands and/or data between the communication device and the electronic control device is made possible.

The key lock according to the invention can also be advantageously developed in such a manner that the key lock has a sensor device for detecting the presence or non-presence of a key of the key lock and is designed for wirelessly transmitting an information signal, specifying the presence or non-presence of the key, to the signal box. This is advantageous since, by means of the sensor device and the communication device, the signal box can be informed about whether a or the key of the key lock is present, that is to say inserted into the key lock, or not.

According to a further preferred embodiment, the key lock according to the invention is formed in such a manner that the key lock has an actuator device for releasing or blocking the removal of the key from the key lock and is designed for wirelessly receiving a release signal, specifying the permission or blocking of the removal of the key, from the signal box. In this context, the actuator device ensures that a removal of the key from the key lock can take place exclusively following the reception of the release signal.

This enables the signal box to check the removal of the key from the key lock and thus lastly the position of the associated switching element even in the case of the wireless linkage of the key lock to the signal box. The actuator device and the sensor device can be advantageously implemented as a common component in the form of a sensor/actuator device. In this context, the sensor/actuator device can be implemented, for example, as an electromagnetic lock used both for holding and for detecting the key.

The invention also comprises an arrangement having a key lock according to the invention or, respectively, a key lock according to one of the preferred developments, described above, of the key lock according to the invention and having at least one switching element secured by the key lock. The switching element secured by the key lock can be, in principle, an arbitrary switching element to be monitored or to be secured for reasons of rail safety technology. According to a particularly preferred development of the arrangement according to the invention, the switching element is a switch, a track lock, a barrier, a signal or a signal lever. This is advantageous since these are such switching elements which are usually secured by using key locks.

In the text which follows, the invention will be explained in greater detail with reference to an exemplary embodiment, in which the

BRIEF DESCRIPTION OF THE INVENTION

The single FIGURE of the drawing shows in a diagrammatic sketch an exemplary embodiment of the arrangement according to the invention using an exemplary embodiment of the key lock according to the invention and a switching element in the form of a switch.

DESCRIPTION OF THE INVENTION

The diagrammatic representation of the FIGURE shows a key lock 10 in the form of a block diagram. The key lock 10 has a processing device 15 which comprises an electronic control device 20, a communication device 25 with an antenna 30 and a sensor/actuator device 35. The processing device 15 indicates that the electronic control device 20, the communication device 25 and the sensor/actuator device 35 can be designed as a common component, for instance in the form of a radio sensor. As an alternative, the devices mentioned could also be designed as separate components, however. The electronic control device 20 is linked via communication links 40 and 41, respectively, to the communication device 25 and the sensor/actuator device 35. The communication device 25 is connected to its antenna 30 via a further communication link 42.

Apart from the processing device 15, the key lock 10 has a line-independent decentralized power supply device 50 for autonomously providing the electrical power needed for operating the key lock 10. The essential factor in this context is that the power supply device 50 does not have a cable link to an external centralized power supply device. Instead, the electrical power needed for operating the key lock 10 is provided by the power supply device 50 itself. In this context, electrical power from the environment of the key lock 10 can be generated or converted by means of so-called "energy harvesting". This can be done, for example, by using solar cells or also converters for generating electrical power from mechanical vibrations. In the latter case, the key lock 10 can be operated, for example, by means of electrical power which is generated from vibrations which are caused by passing trains. In addition, the power supply device 50 can also be designed, for example, for generating electrical power from wind.

The power supply device 50 is connected to the processing device 15 via an internal electrical supply line 55 so that all components of the processing device 15, that is to say, particularly the electronic control device 20, the communication device 25, the antenna 30 and the sensor/actuator device 35, can be supplied with electrical power by the power supply device 50.

According to the representation of the FIGURE, the key lock 10 is arranged in an area in which a main track 100 branches into a side track 110 by means of a switch 105. In this context, the side track 110 can be, for example, a connecting track to a gravel quarry. The switch 105 is a locally operated or locally set switch which is secured by means of the key lock 10. For this purpose, the key lock 10 is linked to a signal box 115 by means of the communication device 25 via the antenna 30. In this context, it is assumed within the context of the exemplary embodiment described that the communication between the key lock 10 and the signal box 115 takes place by means of a direct radio link so that the signal box 115 also has an antenna 120 for this purpose.

When the key lock 10 is in operation, it is now possible, by means of a sensor device of the sensor/actuator device 35, to detect the presence or non-presence of a or the key of the key lock 10 and to transmit a corresponding information signal to the signal box 115. In this context, a wireless radio-based transmission takes place by means of the communication device 25 and the antennas 30 and 120. Depending on the respective implementation, the information signal can be transmitted once or also cyclically.

In general, it must be pointed out that, due to the safety-related significance of the key lock 10, the communication between the key lock 10 and the signal box 115 takes place preferably via a secured radio link. Corresponding mechanisms, that is to say, for example, corresponding secure protocols, are known as such and can be selected or implemented in dependence on the respective requirements and conditions.

Releasing or blocking the removal of the key from the key lock (10) is possible by means of an actuator device of the sensor/actuator device 35. The key lock 10 is also designed for wirelessly receiving a release signal, specifying the permission or blocking of the removal of the key, from the signal box (115). This means that a removal of the key from the key lock 10 is possible exclusively after corresponding release by the signal box 115.

It should be pointed out that, in deviation from the representation of the FIGURE, instead of a manually operated or locally set switch 105, other types of switching elements could also be secured by the key lock 10. Corresponding switching elements could be, for example, a track lock, a barrier, a signal or a signal lever.

Independently of the type of switching element to be secured, the key lock 10 has fundamental advantages with regard to its practical applicability. Thus, considerable advantages with regard to expenditure and costs arise especially for securing those switching elements which are arranged at remote outposts. The reason for this is that no cables or lines have to be conducted or run to the key lock 10. This applies both with regard to the communicative linkage of the key lock 10 to the signal box 115 and also with regard to supplying the key lock 10 with electrical power.

In addition, the wireless linkage of the key lock 10 to the signal box 115 also makes it possible to bridge relatively long distances between the key lock 10 and the signal box 115. Thus, a restriction in distance exists usually in the case of components linked line-dependently to a signal box in the context of rail safety technology to the extent that the distance between the component and the signal box must not exceed 6.5 km. Due to the fact that, in the case of the key lock 10 described, corresponding lines or cables are omitted and, instead, there is wireless communication, the flexibility with regard to the applicability of key locks is thus advantageously increased further.

In summary, it can be said, therefore, that the key lock 10 described can be used particularly flexibly and cost-effectively for securing a switching element and thus entails considerable advantages in practice.

The invention claimed is:

1. A key lock, comprising:

a communication device for wirelessly linking the key lock to a signal box;

a line-independent power supply device for autonomously providing electrical power needed for operating the key lock;

a sensor device for detecting a presence or non-presence of a key of the key lock and the key lock wirelessly transmitting an information signal via said communication device, specifying a presence or a non-presence of the key, to the signal box; and an actuator device for releasing or blocking a removal of the key from the key lock and the key lock wirelessly receiving a release signal, from the signal box, specifying permission or the blocking of the removal of the key.

2. The key lock according to claim 1, further comprising an electronic control device.

3. The key lock according to claim 2, further comprising a communication link connecting said communication device to said electronic control device.

4. A key lock configuration, comprising:

a signal box;

a key lock containing a communication device for wirelessly linking said key lock to said signal box, said key lock containing:

a key;

a sensor device for detecting a presence or non-presence of said key and said key lock wirelessly transmitting an information signal via said communication device, specifying a presence or a non-presence of said key, to said signal box; and an actuator device for releasing or blocking a removal of said key from said key lock and said key lock wirelessly receiving a release signal, from said signal box, specifying permission or the blocking of the removal of the key;

a line-independent power supply device for autonomously providing electrical power needed for operating said key lock; and at least one switching element secured by said key lock.

5. The key lock configuration according to claim 4, wherein said switching element is selected from the group consisting of a switch, a track lock, a barrier, a signal and a signal lever.

* * * * *